US011946661B2

(12) United States Patent
Rohde

(10) Patent No.: US 11,946,661 B2
(45) Date of Patent: Apr. 2, 2024

(54) VARIABLE AIRFLOW ENERGY EFFICIENT HVAC SYSTEMS AND METHODS

(71) Applicant: Robert M. Rohde, Sandy, OR (US)

(72) Inventor: Robert M. Rohde, Sandy, OR (US)

( * ) Notice: Subject to any disclaimer, the term of this patent is extended or adjusted under 35 U.S.C. 154(b) by 0 days.

(21) Appl. No.: 17/492,976

(22) Filed: Oct. 4, 2021

(65) Prior Publication Data

US 2022/0243944 A1 Aug. 4, 2022

Related U.S. Application Data

(60) Provisional application No. 63/143,207, filed on Jan. 29, 2021.

(51) Int. Cl.

| | |
|---|---|
| ***F24F 11/46*** | (2018.01) |
| ***F24F 3/00*** | (2006.01) |
| ***F24F 11/00*** | (2018.01) |
| ***F24F 13/10*** | (2006.01) |
| ***F24F 110/12*** | (2018.01) |

(52) U.S. Cl.

CPC ..... *F24F 11/46* (2018.01); *F24F 3/00* (2013.01); *F24F 13/10* (2013.01); *F24F 2011/0002* (2013.01); *F24F 2110/12* (2018.01)

(58) Field of Classification Search

CPC ..... F24F 3/052; F24F 3/0527; F24F 3/0525; F24F 3/0522; F24F 2011/0002; F24F 2110/12; F24F 13/10; F24F 3/00; F24F 11/46; F24F 2003/0448; F24F 3/0444; F24F 2003/006

See application file for complete search history.

(56) References Cited

U.S. PATENT DOCUMENTS

| | | | |
|---|---|---|---|
| 2,254,185 | A | 8/1941 | Newton |
| 2,609,183 | A | 9/1952 | Fitzgerald |
| 2,755,072 | A | 7/1956 | Kruettner |
| 2,793,812 | A | 5/1957 | McDonald |
| 2,984,459 | A | 5/1961 | Waterfill |
| 3,167,253 | A | 1/1965 | Church et al. |
| 3,508,604 | A | 4/1970 | Foust |
| 3,521,700 | A | 7/1970 | Knowles et al. |
| 3,595,475 | A | 1/1971 | Morton |
| 3,612,164 | A | 10/1971 | Miner |
| 3,623,543 | A | 11/1971 | Ostrander |

(Continued)

FOREIGN PATENT DOCUMENTS

| | | |
|---|---|---|
| EP | 908683 | 4/2003 |
| JP | 5180531 | 7/1993 |

(Continued)

OTHER PUBLICATIONS

Translation of JP2011220638A (Year: 2011).*

*Primary Examiner* — Schyler S Sanks
(74) *Attorney, Agent, or Firm* — Girth Janke, LLC

(57) ABSTRACT

Variable airflow energy efficient HVAC systems can be used to provide for a three duct air supply, a multi-zone air supply, and a two duct air supply. The systems include an air handling unit that defines a cooling circuit portion and an independent heating/bypass circuit portion. The two circuit portions may each have variable air dampers for admitting variable amounts of ambient and return air, and/or the cooling circuit portion and the heating/bypass circuit portion may each have an active cooling element. Corresponding methods are also disclosed.

13 Claims, 6 Drawing Sheets

(56) References Cited

U.S. PATENT DOCUMENTS

| | | | | |
|---|---|---|---|---|
| 3,635,245 | A | 1/1972 | Canfield | |
| 3,820,713 | A | 6/1974 | Demaray | |
| 3,847,210 | A | 11/1974 | Wells | |
| 3,853,173 | A | 12/1974 | Osheroff | |
| 3,911,953 | A | 10/1975 | Crombie et al. | |
| 3,994,335 | A | 11/1976 | Perkins | |
| 4,008,756 | A | 2/1977 | Hufford | |
| 4,019,566 | A | 4/1977 | Cobb | |
| 4,164,976 | A | 8/1979 | Timmerman | |
| 4,531,573 | A | 7/1985 | Clark et al. | |
| 4,795,088 | A | 1/1989 | Kobayashi et al. | |
| 4,987,748 | A | 1/1991 | Meckler | |
| 5,117,899 | A | 6/1992 | Skimehorn | |
| 5,461,877 | A | 10/1995 | Shaw et al. | |
| 5,531,800 | A | 7/1996 | Sewell et al. | |
| 5,931,227 | A | 8/1999 | Graves | |
| 6,386,281 | B1 | 5/2002 | Ganesh et al. | |
| 6,604,688 | B2 | 8/2003 | Ganesh et al. | |
| 7,063,140 | B1 | 6/2006 | Woo | |
| 7,251,953 | B2 | 8/2007 | Wetzel et al. | |
| 7,726,582 | B2 | 6/2010 | Federspiel | |
| 8,141,374 | B2 | 3/2012 | Hay | |
| 8,326,464 | B2 | 12/2012 | Clanin | |
| 9,121,620 | B2 | 9/2015 | Rohde | |
| 9,612,024 | B2 | 4/2017 | Rohde | |
| 2002/0125333 | A1 | 9/2002 | Ganesh et al. | |
| 2006/0117769 | A1 | 6/2006 | Helt et al. | |
| 2009/0236432 | A1* | 9/2009 | Malloy | F24F 11/77 700/282 |
| 2010/0012291 | A1* | 1/2010 | Sporie | F25B 13/00 165/61 |
| 2013/0014927 | A1* | 1/2013 | Dazai | F24F 3/044 165/208 |
| 2013/0096722 | A1 | 4/2013 | Clanin | |
| 2013/0320573 | A1 | 12/2013 | Fisher et al. | |
| 2014/0014291 | A1 | 1/2014 | Kraft | |
| 2014/0138076 | A1* | 5/2014 | Heberer | F24F 11/70 165/251 |
| 2014/0349563 | A1* | 11/2014 | Honda | F24F 1/0035 454/256 |
| 2015/0323213 | A1* | 11/2015 | Rohde | F24F 7/08 165/212 |
| 2015/0338114 | A1* | 11/2015 | Bauer | F24F 11/30 454/338 |
| 2015/0378404 | A1* | 12/2015 | Ogawa | G05B 15/02 700/300 |
| 2016/0209070 | A1* | 7/2016 | Hrejsa | F24F 11/30 |
| 2017/0300046 | A1* | 10/2017 | Kerbel | F24F 11/38 |

FOREIGN PATENT DOCUMENTS

| | | |
|---|---|---|
| JP | 642769 | 2/1994 |
| JP | 2006-200847 | 8/2006 |
| JP | 2011220638 A * | 11/2011 |

* cited by examiner

VARIABLE AIRFLOW ENERGY EFFICIENT HVAC SYSTEMS AND METHODS

FIELD OF INVENTION

The present invention relates to commercial heating, ventilation and air conditioning ("HVAC") systems and methods.

BACKGROUND

The types of HVAC systems to which the present invention is directed are typically used in multi-storey office buildings. It is necessary to provide both temperature control and adequate ventilation everywhere within the building. To that end, the internal building space is typically divided into a number of individual "zones" of temperature and airflow control, each of which includes at least one temperature sensor and means for setting the temperature in the zone, and at least one "air quality" sensor that monitors the amount of carbon dioxide or oxygen in the zone.

These systems are based on one or more "air handling units" that are typically installed on the roof of the building or in a mechanical room in the building, that draw outside or "ambient" air to supply the fresh air needed for ventilating the zones. The air handling units include heating and cooling elements for heating and cooling the air as needed. And the air handling units include fans for drawing the ambient air, and for drawing air that has been returned to the air handling units (called "return air"), and forcing the air into the zones through "ducts" that run throughout the building, typically on or above the building's ceilings.

The air handling units provide the heating and cooling needed to maintain the zones at the desired temperatures, which is typically but not necessarily the same temperature for all the zones, and which is typically but not necessarily 70 degrees F. during "occupied hours of the building," i.e., hours during which the building is occupied.

The zones have heating input from electrical equipment such as lights and computers in the zones, and during occupied hours of the building the zones have both carbon dioxide input and additional heating input from people m the zones.

There are in general two types of zones: "interior" and "exterior." Exterior zones are exposed to exterior walls and windows. Heat will be lost from exterior zones to the walls and windows of the building when the ambient air is colder than the temperature maintained in the zones; whereas heat will be gained by exterior zones from the walls and windows when the ambient air is hotter than the temperature maintained in the zones, and heat will also be gained by these zones through windows during times of sun exposure regardless of the ambient air temperature.

Interior zones are by definition fully surrounded, and therefore insulated, by exterior zones that are being kept at the desired temperature. So if all the zones are maintained at the same temperature, interior zones will experience no heat loss or heat gain from the walls.

The present inventor has two prior patents in the general field of the invention: U.S. Pat. Nos. 9,121,620 and 9,612,024, the entireties of which are hereby incorporated by reference herein. It is an objective of the present invention to improve upon these systems, to provide for commercial HVAC systems that are even more energy efficient.

SUMMARY

A variable airflow energy efficient HVAC system is disclosed for heating, ventilating, and air conditioning a building. Three embodiments are disclosed to provide for a three duct air supply, a multi-zone air supply, and a two duct air supply.

For all three embodiments, the system includes at least one air handling unit.

A disclosed air handling unit with multiple cooling elements may be used in all three embodiments. The air handling unit with multiple cooling elements has a cooling circuit portion for providing a cold air airstream and having a first active cooling element disposed in the cold air airstream; and a heating/bypass circuit portion for providing a heating/bypass air airstream, independent of the cold air airstream and including a second active cooling element disposed in the heating/bypass air airstream or a portion thereof.

For either of the two and three duct embodiments, where the building has a cold air supply duct and a bypass air supply duct, the air handling unit may have a first fan for propelling the cold air airstream into the cold air supply duct, and a second fan for propelling the heating/bypass air airstream or a portion thereof, into the bypass air supply duct.

For the two duct embodiment, the air handling unit may be provided in combination with an active heating element disposed in the heating/bypass air airstream, inside the building and downstream of the air handling unit.

For the three duct embodiment, where the building also has a hot air supply duct, the heating/bypass air airstream may be divided into a hot air supply portion and a bypass air supply portion in the heating/bypass circuit portion of the air handling unit, so that the second fan may be employed for propelling the hot air portion of the heating/bypass airstream into the hot air supply duct and for propelling the bypass air portion of the heating/bypass airstream into the bypass air supply duct, and the heating/bypass circuit portion of the air handling unit may include an active heating element disposed in the hot air portion of the heating/bypass airstream.

For the multi-zone embodiment, where the building has an air supply duct of which multiple instances may be provided, the heating/bypass air airstream may be divided into a hot air supply portion and a bypass air supply portion in the heating/bypass circuit portion of the air handling unit, the second active cooling element may be disposed in the bypass air supply portion of the heating/bypass air airstream, and the air handling unit may also include an active heating element disposed in the hot air supply portion of the heating/bypass air airstream, a first fan for propelling the cold air airstream into the air supply duct through a variably adjustable cold deck air damper, and a second fan for propelling the bypass air airstream into the air supply duct through a variably adjustable bypass deck air damper, and for propelling the hot air airstream into the air supply duct through a variably adjustable hot deck air damper.

Also for the multi-zone embodiment, where the building is divided into multiple zones and provided with a plurality of instances of the air supply duct for serving each zone, the air handling unit may have a corresponding plurality of instances of the cold deck air damper, the bypass deck air damper, and the hot deck air damper.

Any of the air handling units with multiple cooling coils may also be provided with multiple sets of ambient and return air dampers, where "return air" refers to air intended to be obtained from a return air duct in the building. In particular, the air handling unit with multiple cooling coils may include an ambient air damper for admitting ambient air into the cold air airstream, and a return air damper for variably adjustably admitting return air from the return air duct into the cold air airstream, and another ambient air damper for admitting ambient air into the heating/bypass air airstream, and another return air damper for variably adjustably admitting return air into the heating/bypass air airstream.

Other HVAC systems for use in a building are also disclosed. All these systems include an air handling unit and a controller, and where there is reference to "return air," the building is also presumed to have a return air duct.

One such system employs the aforedescribed air handling unit with multiple cooling elements, and the controller is configured to control both active cooling elements so as to cool both the cold air airstream and the heating/bypass air airstream or a portion thereof under a hot ambient air condition.

The controller may be further configured to control both active cooling elements so as to cool the cold air airstream more than the heating/bypass air airstream or portion thereof under the hot ambient air condition.

Another such system employs an air handling unit having a cooling circuit portion for providing a cold air airstream and an active cooling element disposed in the cold air airstream, a heating/bypass circuit portion for providing a heating/bypass air airstream, independent of the cold air airstream, an ambient air damper for variably adjustably admitting ambient air into the heating/bypass air airstream, and a return air damper for variably adjustably admitting return air from the return air duct into the heating/bypass air airstream. The controller is configured to control the ambient and return air dampers under a cold or mild ambient air condition so as to mix ambient and return air as needed to satisfy a predetermined ventilation requirement in the building.

Still another such system employs an air handling unit having a cooling circuit portion for providing a cold air airstream and an active cooling element disposed in the cold air airstream, the air handling unit also having a heating/bypass circuit portion for providing a heating/bypass air airstream, independent of the cold air airstream, and a return air damper for admitting return air into the heating/bypass air airstream. The controller is configured to close the return air damper under a hot ambient air condition.

Where the air handling unit also has an ambient air damper for admitting ambient air into the cold air airstream, the controller may be further configured to close the ambient air damper under the hot ambient air condition.

Yet another such system employs an air handling unit having a cooling circuit portion for providing a cold air airstream, an active cooling element disposed in the cold air airstream, and an ambient air damper for admitting ambient air into the cold air airstream. The controller is configured to close the ambient air damper under a hot ambient air condition.

Also disclosed are methods corresponding to the above-described systems. All these methods include providing a cold air airstream for distribution in the building, and a heating/bypass air airstream for distribution in the building, independent of the cold air airstream.

One such method includes cooling both the cold air airstream and the heating/bypass air airstream or a portion thereof under a hot ambient air condition.

The method may further include cooling the cold air airstream more than the heating/bypass air airstream or portion thereof under the hot ambient air condition.

Another such method for use in a building having a return air duct includes mixing ambient air with return air from the return air duct into the bypass/heating air airstream under a cold or mild ambient air condition as needed to satisfy a predetermined ventilation requirement in the building.

Still another such method for use in a building having a return air duct provides a return air damper for admitting return air from the return air duct into the heating/bypass air airstream, and includes closing the return air damper under a hot ambient air condition.

Yet another such method further provides an ambient air damper for admitting ambient air into the cold air airstream, and includes closing the ambient air damper under a hot ambient air condition.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DESCRIPTION OF PREFERRED EMBODIMENTS

It was noted above that the air handling units of typical commercial HVAC systems have heating and cooling "elements" that heat or cool the air as needed to maintain the desired air temperatures in the zones. Those elements are often provided in the form of "coils" through which a chilled or heated fluid, such as water, or a refrigerant, or an electrical current, is passed, and will be referred to herein as "heating coils" and "cooling coils" for ease of discussion, it being understood that other types of heating and cooling elements can be used.

The term "cooling" will be used herein to refer to passing air over or through a cooling coil (or other cooling element) for cooling the air; and the term "heating" will be used herein to refer to passing air over or through a heating coil (or other heating element) for heating the air. The significance of such "heating" and "cooling" is that it requires an expenditure of energy.

Three examples of variable airflow energy efficient HVAC systems according to the present invention will be described herein, starting with a "three duct" air supply system 10.

Three Duct Air Supply System

Figure 1:
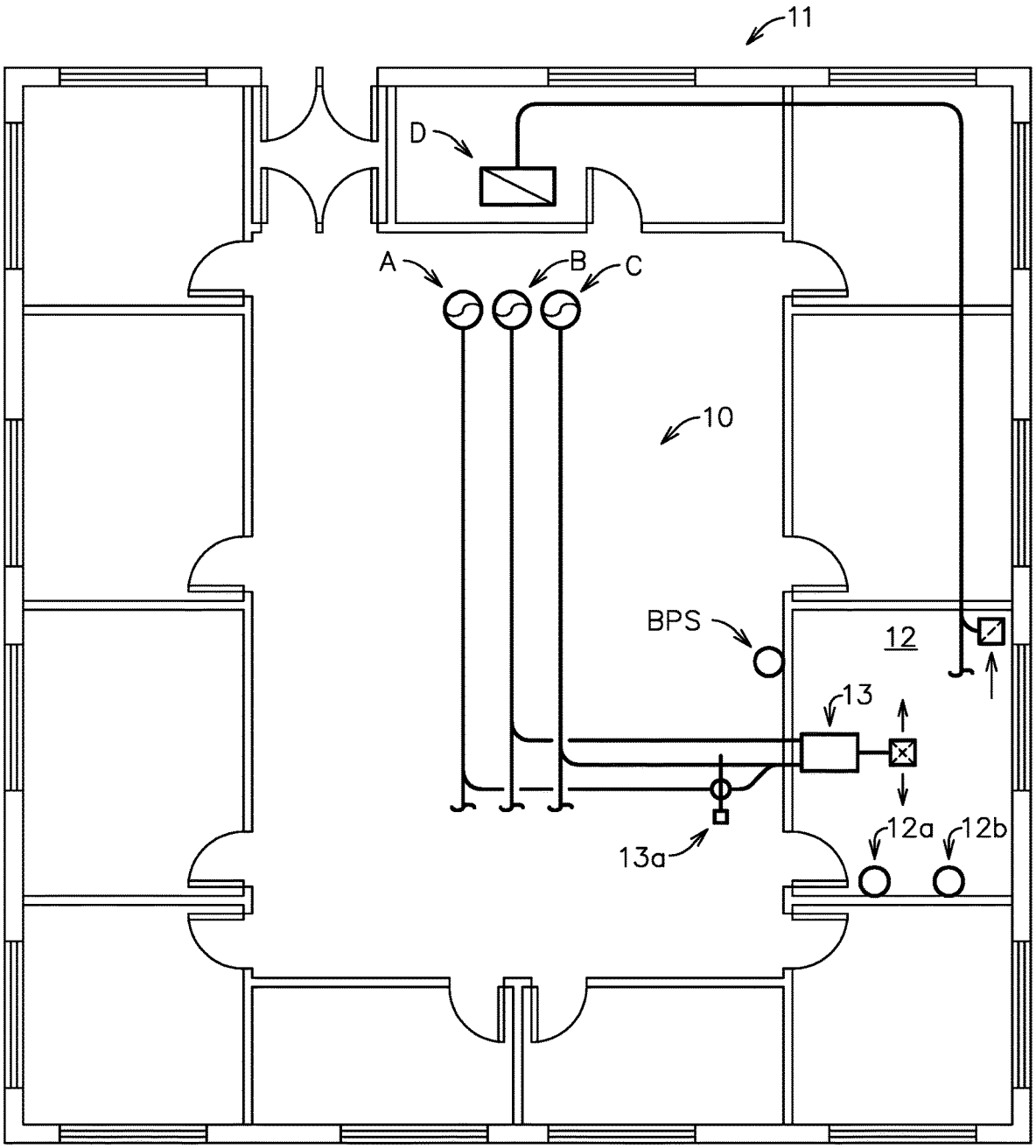
FIG. 1 is a plan view of a floor of a building, showing a zone with three supply ducts and a terminal unit for admitting airflow into the zone from the three supply ducts in a "three duct" air supply embodiment of a variable airflow, energy efficient HVAC system according to the present invention.

FIG. 1 shows a zone 12 of a building 11 in which the three air supply duct system 10 is employed. The building may be any building, but is typically a multi-storey office building. There are typically multiple zones on a single floor of the building, and zone 12 is shown as being representative. The zone 12 is shown as being an exterior zone, but it can be either an interior or exterior zone.

The three duct system 10 can be characterized by the use of three ducts to serve the HVAC needs of the zone 12, the ducts being referenced here as "A," "B," and "C." Also shown are a standard temperature sensor 12*a* and a standard air quality sensor 12*b* for the zone 12. All the zones would normally have the same sensors.

Figure 2:
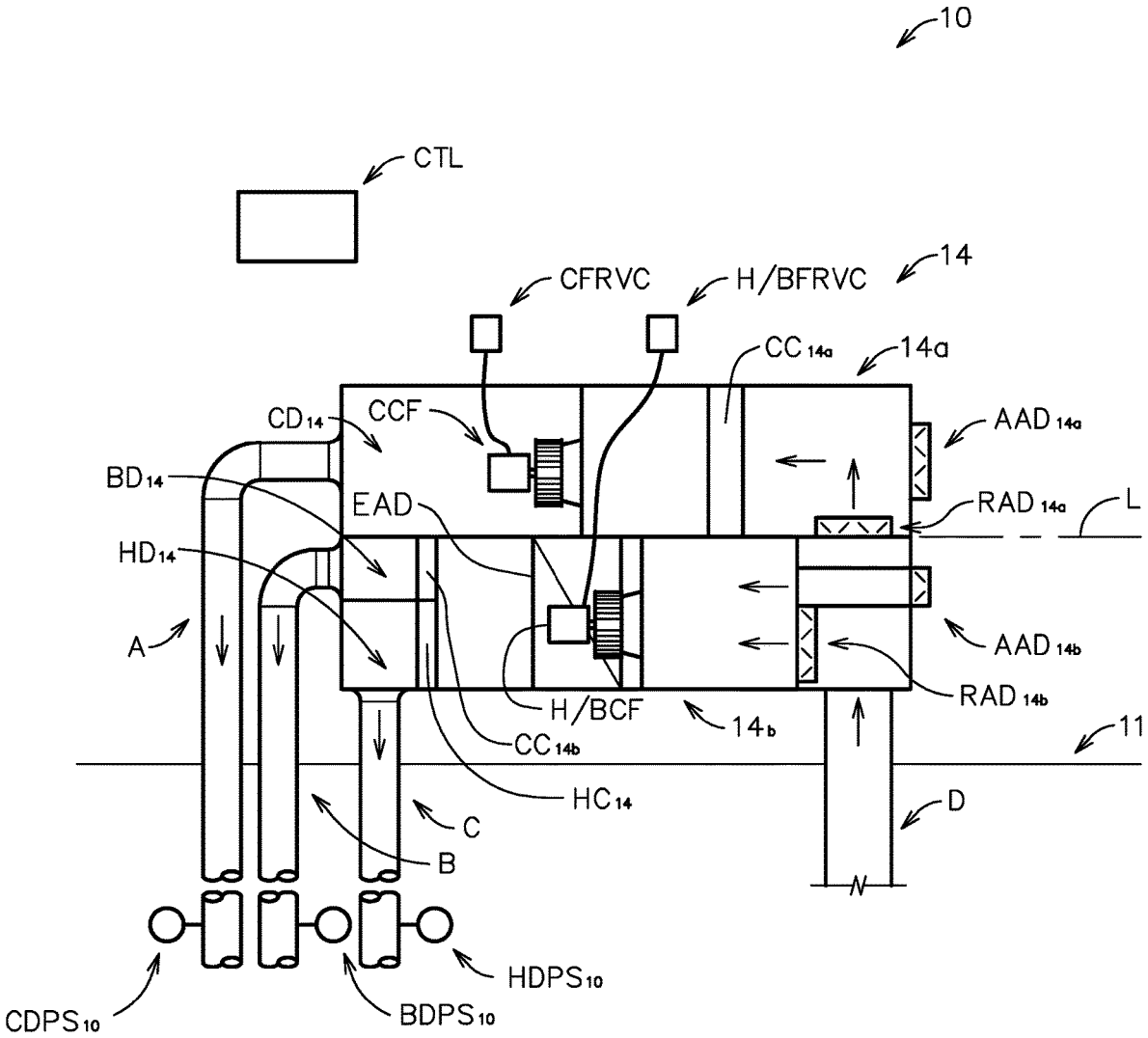
FIG. 2 is a schematic, elevation view of an air handling unit for use in combination with the three supply ducts and terminal unit of FIG. 1.

FIG. 2 shows an air handling unit 14 for the three duct system 10, which in this example is mounted on top of the building 11. The air handling unit 14 provides airflow to the building through the ducts A, B, and C. According to the invention, the air handling unit 14 can be thought of as being divided into two "circuit" portions: a "cooling" circuit portion 14*a*, and a "heating/bypass" circuit portion 14*b*. The two circuit portions are divided at the line "L," which corresponds to a barrier between the two circuit portions that prevents air from being exchanged between the two circuit portions.

The cooling circuit portion 14*a* is for cooling the zones with cool or cold air as needed, and the heating/bypass circuit portion 14*b* is for both ventilating the zones and heating the zones with warm or hot air as needed.

With reference to both FIGS. 1 and 2, a full circuit, of which the two circuit portions 14*a* and 14*b* of the air handling unit 14 are integral parts, is defined by airflow from the air handling unit, through the air supply ducts into the zone 12, and back to the air handling unit 14 through a "return air" duct "D."

As for all zones in the building, it is necessary to satisfy both the temperature sensor and the air quality sensor.

To facilitate these requirements according to the invention, each of the two circuit portions 14*a* and 14*b* of the air handling unit 14 is preferably provided with an "ambient air damper," referenced here as "$AAD_{14a}$" and "$AAD_{14b}$." These air dampers may be of the standard type known and commonly used in the art to allow for varying, selectably controlled airflow. As provided according to the invention, these air dampers allow for variable, modulated amounts of ambient air from outside the building to enter the respective circuit portions of the air handling unit. When the dampers are "closed," the variable airflow is at its minimum, which is typically essentially zero.

In addition, each of the two circuit portions 14*a* and 14*b* of the air handling unit 14 is preferably provided with a "return air damper," referenced here as "$RAD_{14a}$" and "$RAD_{14b}$." These may be the same types of air dampers as the ambient air dampers. As provided according to the invention, the return air dampers allow for variable, modulated amounts of return air from the return air duct D to enter the respective circuit portions of the air handling unit.

Thus, suitable operation of the ambient air damper $AAD_{14a}$ and the return air damper $RAD_{14a}$ in combination can provide for any desired mixture of ambient and return air as input to the cooling circuit portion 14*a* of the air handling unit 14; and likewise, suitable operation of the ambient air damper $AAD_{14b}$ and the return air damper $RAD_{14b}$ in combination can provide for any desired mixture of ambient and return air as input to the heating/bypass circuit portion 14*b* of the air handling unit.

The present inventor has identified three ambient air conditions pertinent to the operation of the system 10 as follows: (1) "Cold" ambient air conditions, where the ambient air is cold enough that none of the zones in the building require cooling; (2) "Hot" ambient air conditions, where the ambient air is hotter than the temperature(s) maintained in the zones, so that all the zones will require at least some cooling; and (3) "Mild" ambient air conditions, where the ambient air is colder than the temperature(s) maintained in the zones, but not cold enough to avoid the need for at least some cooling. These three different ambient air conditions allow for defining the air flowing in the ducts A, B, and C.

A cooling circuit fan "CCF" in the cooling circuit portion 14*a* of the air handling unit 14 creates negative pressure therein for drawing ambient air through the ambient air damper $AAD_{14a}$, and for drawing return air through the return air damper $RAD_{14a}$, and positive pressure downstream for expelling the mixture into the duct A for delivery to the zone 12.

In addition, the cooling circuit portion 14*a* of the air handling unit has a cooling circuit cooling coil "$CC_{14a}$" for cooling the mixture as needed to satisfy all the building's cooling requirements. But the cooling coil $CC_{14a}$ may be "off" (i.e., no "cooling" as defined herein) and the air may still be "cold" enough to satisfy the temperature sensor 12*a* under "Cold" or "Mild" ambient air conditions. In any case, the duct A will be referred to hereinafter as the "cold air duct" because it supplies cool or cold air as needed, and the output of the cooling circuit portion 14*a* of the air handling unit may be referred to as a cold deck "$CD_{14}$."

Corresponding to the cooling circuit fan CCF, a heating/bypass circuit fan "H/BCF" in the heating/bypass circuit portion 14*b* of the air handling unit 14 creates negative pressure therein for drawing ambient air through the ambient air damper $AAD_{14b}$, and for drawing return air through the return air damper $RAD_{14b}$, and positive pressure downstream for expelling the mixture into the ducts B and C for delivery to the zone 12.

Preferably, the air handling unit has just the two fans, CCF and H/BCF.

The heating/bypass circuit portion 14*b* of the air handling unit has a heating coil "$HC_{14}$" for heating the mixture flowing into the duct C as needed to satisfy all the building's heating requirements. Accordingly, the duct C will be referred to hereinafter as the "hot air duct" because it supplies hot air as needed, and the output of the heating/bypass circuit portion 14*b* downstream of the heating coil $HC_{14}$ may be referred to as a hot deck "$HD_{14}$."

Also in addition, the heating/bypass circuit portion 14*b* of the air handling unit has a heating/bypass circuit cooling coil "$CC_{14b}$" for cooling the mixture flowing into the duct B under certain conditions as will be explained further below. The bypass air duct B will be referred to hereinafter as the "bypass air duct," and the output of the heating/bypass circuit portion 14*b* downstream of the cooling coil $CC_{14b}$ may be referred to as a bypass deck "$BD_{14}$."

Turning back to FIG. 1, each zone has associated therewith at least one "terminal unit" 13 downstream of the air handling unit 14, and upstream of the zone 12, that selects, mixes, and modulates, i.e., provides for variable amounts, of air from the ducts A, B, and C as needed to satisfy the temperature sensor 12*a* and the air quality sensor 12*b* in the zone.

The standard terminal unit 13 is a 2 input-device, and may be employed in combination with a "2-position" or "toggling" damper 13*a* upstream of the terminal unit, that toggles between the cold air duct A and the hot air duct C, and thereby presenting one, but not the other, of these air supplies as one of the two inputs to the terminal unit. The bypass air duct B is provided as the other input to the terminal unit 13.

Turning back to FIG. 2, a cold air duct pressure sensor "$CDPS_{10}$" may be provided for sensing the pressure in the cold air duct A, as part of a cooling fan rotational velocity control circuit "CFRVC" for controlling this pressure. The sensor $CDPS_{10}$ may be positioned anywhere that allows for this sensing, but is preferably positioned between one-half and three-quarters of the way toward the downstream end of the duct. The rotational velocity of the cooling circuit fan CCF is modulated by the cooling fan rotational velocity control circuit CFRVC to create the desired pressure.

Likewise a bypass air duct pressure sensor "$BDPS_{10}$," and a hot air duct pressure sensor "$HDPS_{10}$," may be provided for sensing the pressures in the bypass air duct B and the hot air duct C, respectively. The sensors $BDPS_{10}$ and $HDPS_{10}$ may be positioned anywhere that allows for this sensing, but are preferably positioned between one-half and three-quarters of the way toward the downstream ends of the respective ducts. The sensors $BDPS_{10}$ and $HDPS_{10}$ are parts of a heating/bypass fan rotational velocity control circuit "H/BFRVC" for controlling the pressure in the ducts B and C, where the sensor with the lowest pressure governs. The rotational velocity of the heating/bypass circuit fan H/BCF is modulated by the heating/bypass fan rotational velocity control circuit H/BFRVC to create the desired pressure.

Briefly returning to FIG. 1, in addition, one of the floors of the building may have a building pressure sensor "BPS" positioned therein. And turning back to FIG. 2, an exhaust air damper "EAD" in the heating/bypass circuit portion 14*b* of the air handling unit 14 may be provided to allow for exhausting air from this circuit portion if the pressure at the building pressure sensor BPS is too high.

Some principles of operation of the system are dependent on the ambient air conditions, as follows:

Cold Ambient Air Conditions:

Cold Air Duct A: by suitable control of the ambient air damper $AAD_{14a}$ in combination with the return air damper $RAD_{14a}$, ambient outside air is mixed with return air from the return air duct D and admitted into the cooling circuit portion 14*a* of the air handling unit 14 as needed to obtain an air mixture that is cold enough to satisfy the air temperature sensor(s) 12*a* of the zone requiring the lowest temperature. The cooling coil $CC_{14a}$ is "off," because, by definition, the ambient air is cold enough to obtain the desired low temperature.

Bypass Air Duct B: by suitable control of the ambient air damper $AAD_{14b}$ in combination with the return air damper $RAD_{14b}$, ambient outside air is mixed with return air from the return air duct D and admitted into the heating/bypass circuit portion 14*b* of the air handling unit 14 as needed to satisfy the air quality sensor(s) 12*b* at the zone requiring the most ventilation, to ensure that airflow from the bypass air duct can satisfy the ventilation needs at all the zones.

Hot Air Duct C: the same air mixture as for the bypass air duct B is heated to a high temperature (about 160-165 degrees F.), by use of the heating coil $HC_{14}$ to ensure that airflow the hot deck $HD_{14}$ into the hot air duct can satisfy the heating needs at all the zones, and also to minimize the amount of ambient airflow (i.e., air that will require a heating energy expenditure) from the hot air duct that will be required. Alternatively, the air provided to the hot deck could be heated to the highest temperature needed in the building.

Terminal Units:

The terminal unit 13 for the zone 12 admits into the zone an amount of airflow from the bypass air duct B that is needed to satisfy the air quality sensor(s) 12*b*, and admits an additional amount of airflow from either the cold air duct A or the hot air duct C (by use of the toggling damper 13*a*), depending on whether the zone 12 needs cooling or heating, that is needed to satisfy the temperature sensor(s) 12*a*. The two airflows (i.e., either from the bypass air duct and the cold air duct, or from the bypass air duct and the hot air duct) can simply be added to one another as needed to satisfy both kinds of sensors.

Hot Ambient Air Conditions:

Cold Air Duct A: by suitable control of the ambient air damper $AAD_{14a}$ in combination with the return air damper $RAD_{14a}$, 100% return air from the return air duct D is admitted into the cooling circuit portion 14*a* of the air handling unit 14, without being mixed with ambient air, and is subsequently cooled by use of the cooling coil $CC_{14a}$, to the lowest air temperature needed in the building.

Bypass Air Duct B: by suitable control of the ambient air damper $AAD_{14b}$ in combination with the return air damper $RAD_{14b}$, 100% ambient air from outside the building is admitted into the heating/bypass circuit portion 14*b* of the air handling unit 14 without being mixed with return air, and is subsequently cooled by use of the cooling coil $CC_{14b}$, just enough to bring the air temperature down to the hottest air temperature needed in the building, to ensure that the airflow from the bypass air duct will not need to be heated.

Hot Air Duct C: the same mixture as for the bypass air duct B, with the heating coil $HC_{14}$ for the heating/bypass circuit portion of the air handling unit 14 turned "off" because, by definition, no heating is needed anywhere in the building under Hot ambient air conditions.

Terminal Units:

The terminal unit 13 for the zone 12 admits into the zone an amount of airflow from the bypass air duct B that is needed to satisfy the air quality sensor(s) 12*b*, and admits an additional amount of airflow from the cold air duet A (by use of the toggling damper 13*a*) that is needed to satisfy the temperature sensor(s) 12*a*. The two airflows (i.e., from the bypass air duct and from the cold air duct) can simply be added to one another as needed to satisfy both kinds of sensors.

Mild Ambient Air Conditions:

Cold Air Duct A: by suitable control of the ambient air damper $AAD_{14a}$ in combination with the return air damper $RAD_{14a}$, 100% ambient air is admitted into the cooling circuit portion 14*a* of the air handling unit 14, and cooled by use of the cooling coil $CC_{14a}$ to the lowest temperature needed in the building, to ensure that airflow from the cold air duct can satisfy all the cooling needs of the zones that need cooling.

Bypass Air Duct B: by suitable control of the ambient air damper $AAD_{14b}$ in combination with the return air damper $RAD_{14b}$, ambient air is mixed with return air and admitted into the heating/bypass circuit portion 14*b* of the air handling unit 14 as needed to satisfy the ventilation needs of the zone requiring the most ventilation, to ensure that airflow from the bypass air duct can satisfy the ventilation needs of all the zones.

Hot Air Duct C: the same mixture as for the Bypass Air Duct is heated to a high temperature (about 160-165 degrees F.) by use of the heating/bypass heating coil $HC_{14}$. Again, as an alternative, this air could be heated to the highest temperature needed in the building.

Terminal Units:

The terminal unit 13 for the zone 12 admits into the zone an amount of airflow from the bypass air duct B that is needed to satisfy the air quality sensor(s) 12*b*, and admits an additional amount of airflow from either the cold air duct A or the hot air duct C (by use of the toggling damper 13*a*), depending on whether the zone 12 needs cooling or heating, that is needed to satisfy the temperature sensor(s) 12*a*. The two airflows (i.e., either from the bypass air duct and the cold air duct, or from the bypass air duct and the hot air duct) can simply be added to one another as needed to satisfy both kinds of sensors.

Additional Operating Principles:

The cooling circuit fan CCF, in the cooling circuit portion 14*a* of the air handling unit 14, may be turned "off" if no zone requires cooling, to realize additional energy savings.

On the other hand, the heating/bypass circuit fan H/BCF, in the heating/bypass circuit portion 14*b* of the air handling unit should be continuously "on" during occupied hours of the building, to ensure the necessary ventilation.

Control Circuits:

Control circuits, which may be referred to individually or collectively as a "controller" (referenced in FIGS. 2, 3, and 6 as "CTL") that provide for system operation as described above are known in the art, and may take the form of one or more programmable general or special purpose computers.

Multi-Zone Air Supply System

Figure 3:
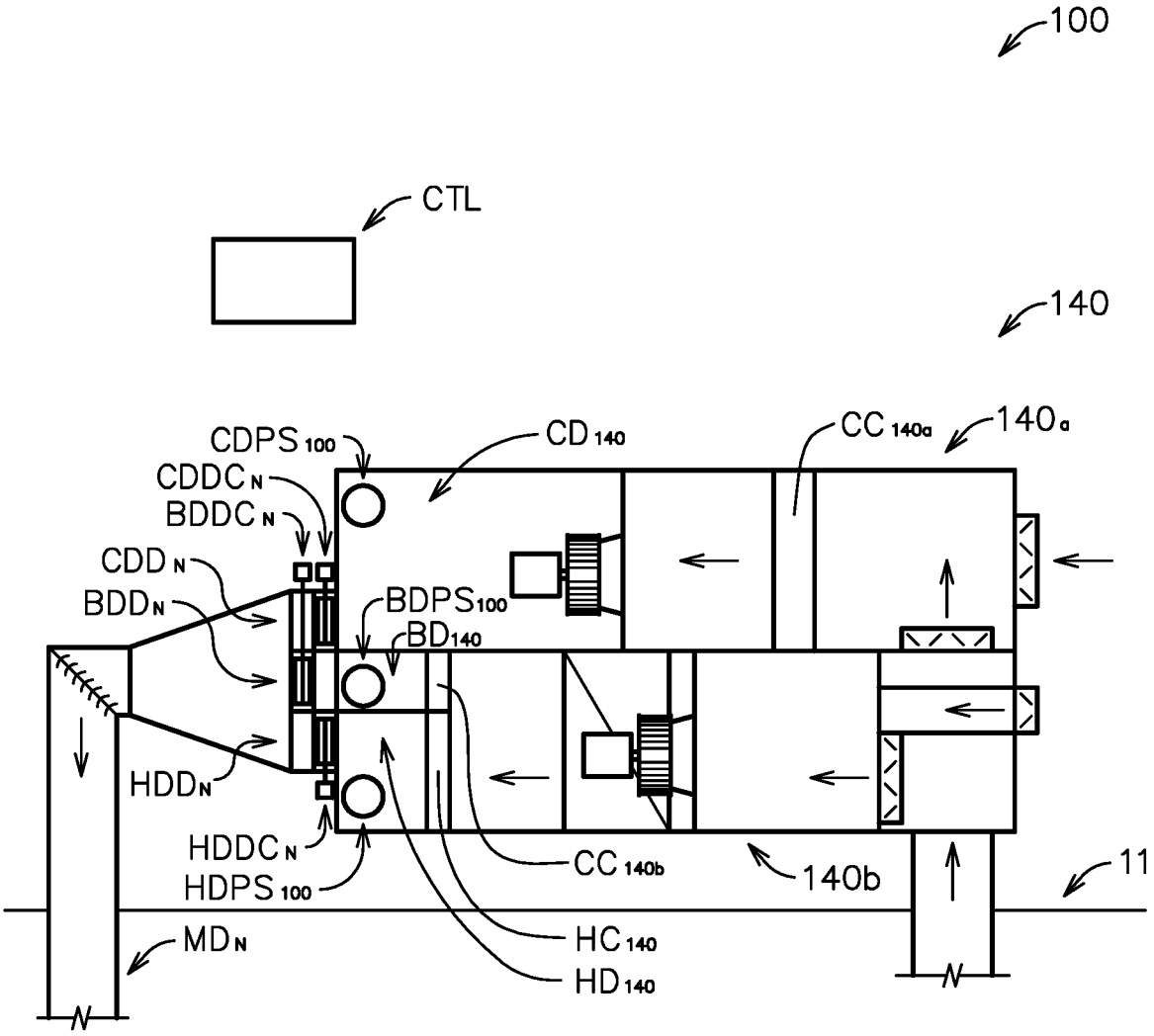
FIG. 3 is a schematic, elevation view of an air handling unit for use in a multi-zone embodiment of a variable airflow, energy efficient HVAC system according to the present invention.
Figure 4:
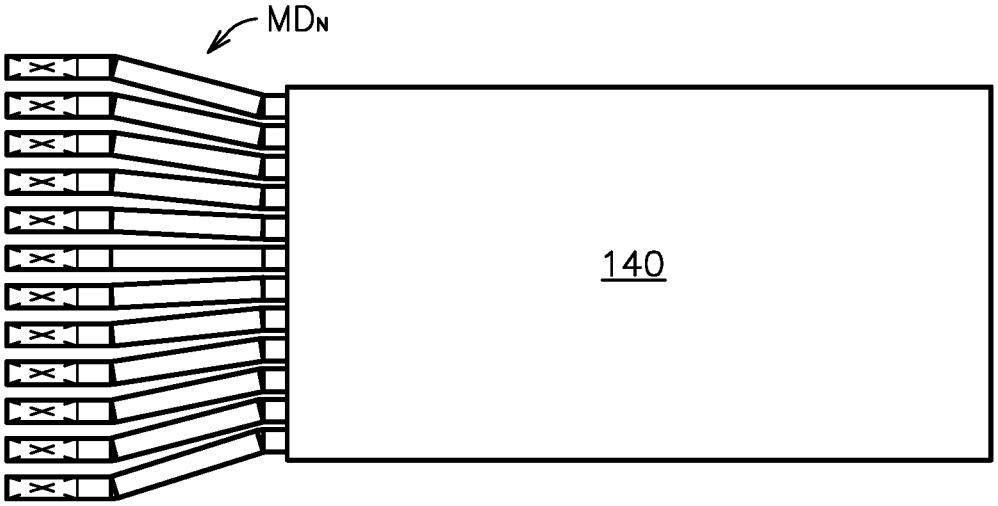
FIG. 4 is a schematic, plan view of the air handling unit of FIG. 3.

FIG. 3 shows an air handling unit 140 for a "multi-zone" air supply system 100 according to the present invention. FIG. 3 corresponds to FIG. 2 for the three duct system 10. And there is an additional plan view of the air handling unit 140 in FIG. 4, which shows that instead of the three ducts shown in FIG. 2 for the three duct supply system 10, the system 100 may have any number of ducts "$MD_N$" (twelve being shown).

Except for the differences noted below, the multi-zone air supply system 100 may be the same and be operated the same as the three duct air supply system 10 as described above.

Figure 5:
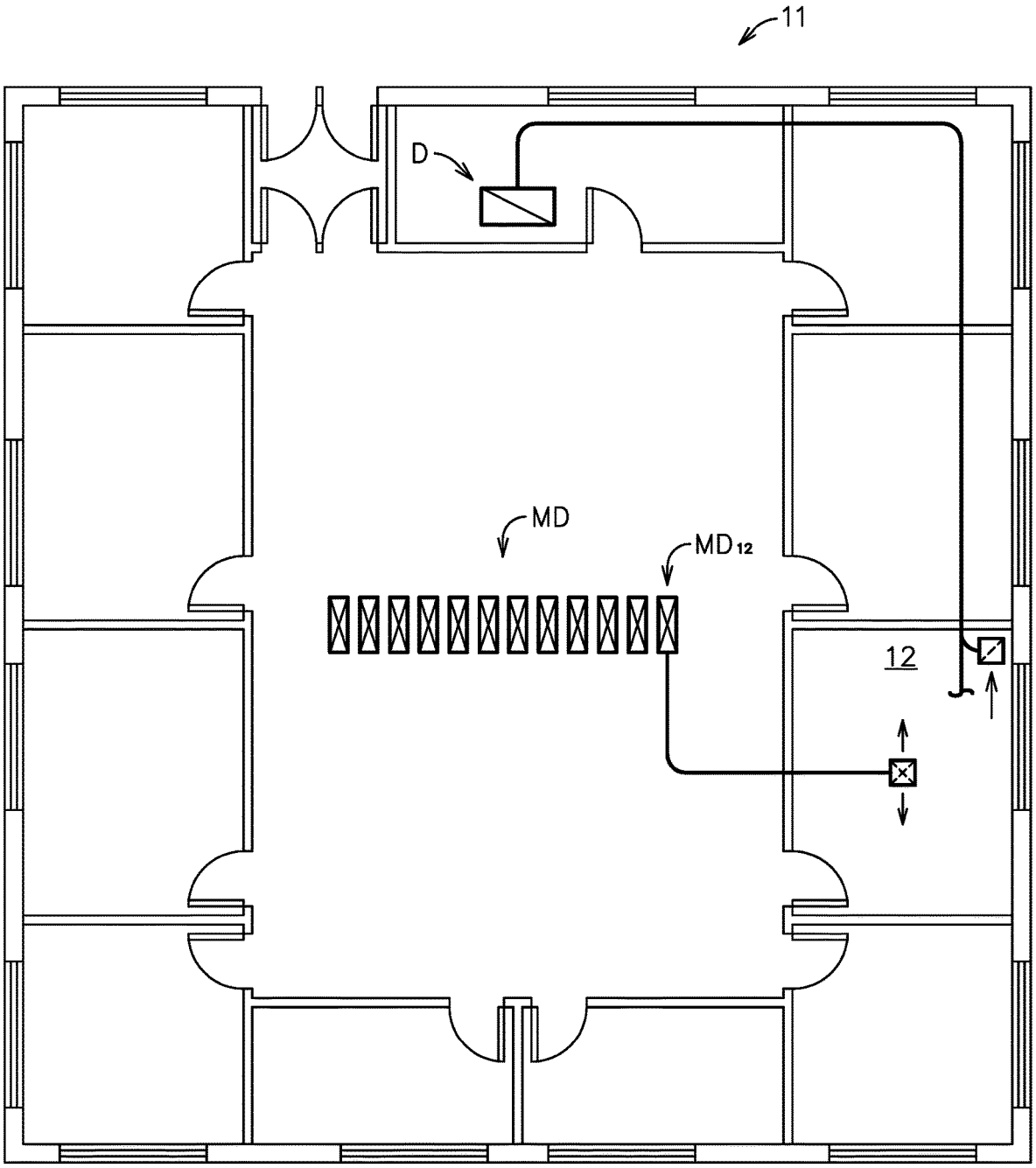
FIG. 5 is a schematic, plan view of a floor of a building, showing multiple air supply ducts, and a representative zone, for use with the air handling unit of FIGS. 3 and 4.

As shown in FIG. 5, each duct MD is dedicated to serving a particular zone, such as the duct $MD_{12}$ for the zone 12, and FIG. 3 shows how the air handling unit 140 feeds the ducts $MD_N$.

In particular, the air handling unit 140 defines a cold deck "$CD_{140}$," a bypass deck "$BD_{140}$," and a hot deck "$HD_{140}$." Each duct $MD_N$ mates to the cold deck $CD_{140}$ through a respective cold deck damper "$CDD_N$" and cold deck damper controller "$CDDC_N$" for controlling the cold deck damper for the duet $MD_N$. Each duct $MD_N$ mates to the bypass deck $BD_{140}$ through a respective bypass deck damper "$BDD_N$" and bypass deck damper controller "$BDDC_N$" for controlling the bypass deck damper $BDD_N$. And each duct $MD_N$ mates to the hot deck $HD_{140}$ through a respective hot deck damper "$HDD_N$" and hot deck damper controller "$HDDC_N$" for controlling the hot deck damper for the duct $MD_N$.

A cooling circuit coil $CC_{140a}$ in the multi-zone system may correspond identically to the cooling circuit coil $CC_{14a}$ in the cooling circuit portion of the three duct system 10; a cooling circuit coil $CC_{140b}$ in the heating/bypass circuit portion 140*b* of the multi-zone system 100 may correspond identically to the cooling circuit coil $CC_{14b}$ in the heating/bypass circuit portion of the three duct system 10; and a heating/bypass heating coil $HC_{140}$ in the heating/bypass circuit portion 140*b* may correspond identically to the heating/bypass heating coil $HC_{14}$ in the system 10.

Referring back to FIG. 2 and as explained previously, the three duct air supply system 10 may include pressure sensors $CDPS_{10}$, $BDPS_{10}$, and $HDPS_{10}$ for sensing the pressure in the cold air duct A, the bypass air duct B, and the hot air duct C, respectively, and these pressure values may be used to control the rotational velocities of the fans serving these ducts. The corresponding functions may be provided in the multi-zone system 100 by use of pressure sensors in the air handling unit 140, $CDPS_{100}$, $BDPS_{100}$, and $HDPS_{100}$, for sensing the pressures in the cold deck $CD_{140}$, the bypass deck $BD_{140}$, and the hot deck $HD_{140}$, respectively.

The three dampers $CDD_N$, $BDD_N$, and $HDD_N$ for the duct $MD_N$ serving a particular zone "N" are operated to achieve the same mixing of airflow that would otherwise have taken place at the terminal unit for the same zone in the three duct system as described above.

Two Duct Air Supply System

Figure 6:
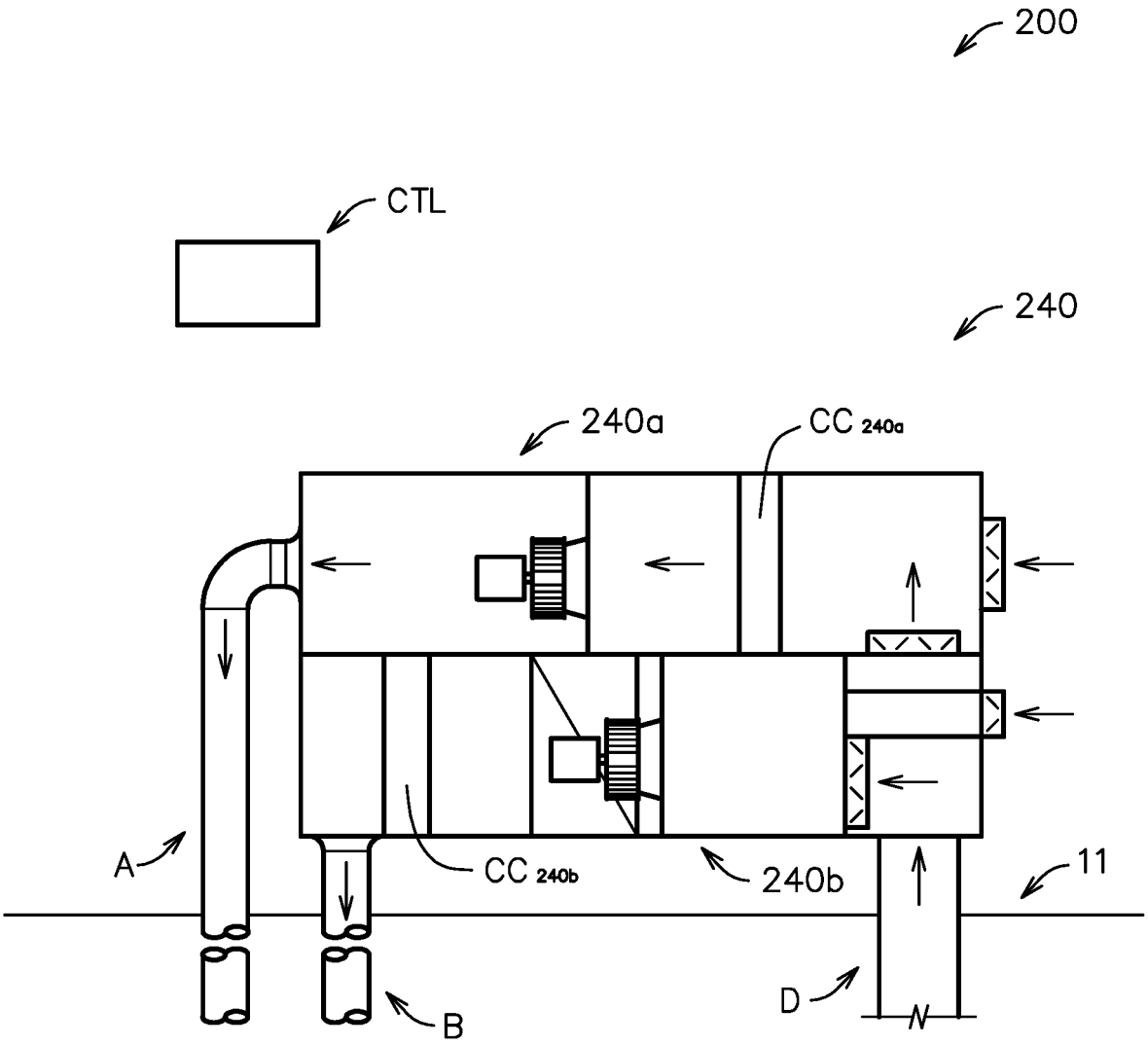
FIG. 6 is a schematic, elevation view of an air handling unit for use in a "two duct" air supply embodiment of a variable airflow, energy efficient HVAC system according to the present invention.

FIG. 6 shows an air handling unit 240 for a "two duct" air supply system 200 according to the present invention. The three duct system 10 may be converted to the two duct system 200 simply by eliminating the hot air duct C in the three duct system 10, and replacing the heating coil $HC_{14}$ in the three duct system with separate heating coils (not shown) for each zone, which may be upstream (in the bypass air duct), downstream, or part of, the terminal unit serving that zone, and if heating is needed at a particular zone, controlling the heating coil for that zone to heat bypass air from the bypass air duct as needed to satisfy the temperature sensor for the zone. And in all other respects, the two duct air supply system may be the same and be operated the same as the three duct air supply system 10 as described above. For example, the cooling coils $CC_{240a}$ and $CC_{240b}$ of, respectively, a cooling circuit portion 240*a* and a heating/bypass circuit portion 240*b* of the air handling unit 240 may correspond identically to the cooling coils $CC_{14a}$ and $CC_{14b}$ of, respectively, the cooling circuit portion 14*a* and the heating/bypass circuit portion 14*b* of the air handling unit 14.

It is to be understood that, while some specific variable airflow energy efficient HVAC systems and methods have been shown and described as preferred, this specification is not intended to describe all the variations that may be employed and recognized by persons of ordinary skill as being consistent with the principles and practice of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. An HVAC system for use in a building having a return air duct, the building being maintained at one or more temperatures, the system comprising:

an air handling unit comprising a cooling circuit portion for providing a cold air airstream, a first return air damper for admitting return air from the return air duct into the cold air airstream, and a first cooling element disposed in the cold air airstream for cooling the cold air airstream, the air handling unit further comprising a bypass circuit portion for providing a bypass air airstream, independent of the cold air airstream, and a second return air damper for admitting return air from the return air duct into the bypass air airstream; and a controller configured to determine a hot ambient air condition where the temperature of the ambient air is higher than the one or more temperatures maintained in the building, close the second return air damper, and use the first return air damper to provide return air to the building in response to the hot ambient air condition.

2. The system of claim 1, the air handling unit further comprising an ambient air damper for admitting ambient air into the cold air airstream, wherein the controller is further configured to close the ambient air damper in response to the hot ambient air condition.

3. The system of claim 1, further comprising a second cooling element disposed in the bypass air airstream for cooling the bypass air airstream, and a second ambient air damper for admitting ambient air into the bypass air airstream, wherein the controller is further configured to open the second ambient air damper and use the second cooling element to cool the admitted ambient air in response to the hot ambient air condition.

4. An HVAC system for use in a building having a plurality of zones, the zones being maintained at one or more temperatures, each zone having at least one terminal unit and at least one air quality sensor, the HVAC system comprising:

an air handling unit comprising a cooling circuit portion for providing a cold air airstream, a cooling element disposed in the cold air airstream, and a cooling circuit ambient air damper for admitting ambient air into the cold air airstream, and a bypass circuit portion for providing a bypass air airstream independent of the cold air airstream and a bypass circuit ambient air damper for admitting ambient air into the bypass air airstream; and a controller configured to determine a hot ambient air condition, where the temperature of the ambient air is higher than the one or more temperatures maintained in the zones, and to close the cooling circuit ambient air damper, and use the bypass ambient air damper for admitting sufficient ambient air into the bypass air airstream to ensure that the terminal units can provide for variable amounts of air as needed to satisfy the respective air quality sensors, in response to the hot ambient air condition.

5. A method for heating, ventilating, and air conditioning a building, wherein there is a lowest temperature needed in the building and a highest temperature needed in the building, the method comprising:

providing a cold air airstream for distribution in the building;

providing a bypass air airstream for distribution in the building, independent of the cold air airstream;

determining a hot ambient air condition, where the temperature of the ambient air is higher than the highest temperature needed in the building; and cooling the cold air airstream to the lowest temperature needed in the building and cooling the bypass air airstream to the highest temperature needed in the building in response to the hot ambient air condition.

6. A method for heating, ventilating, and air conditioning a building having a return air duct, the building being, maintained at one or more temperatures, the method comprising:

providing a cold air airstream for distribution in the building, and a first return air damper for admitting return air from the return air duct into the cold air airstream;

providing a bypass air airstream for distribution in the building, independent of the cold air airstream, and a second return air damper for admitting return air from the return air duct into the bypass air airstream, determining a hot ambient air condition, where the temperature of the ambient air is higher than the one or more temperatures maintained in the building; and closing the second return air damper and using the first return air damper to provide return air to the building in response to the hot ambient air condition.

7. The method of claim 6, further comprising providing an ambient air damper for admitting ambient air into the cold air airstream, and closing the ambient air damper in response to the hot ambient air condition.

8. The method of claim 6, further comprising providing a cooling circuit ambient air damper for admitting ambient air into the cold air airstream, and closing the cooling circuit ambient air damper in response to the hot ambient air condition.

9. The method of claim 8 wherein the building has a plurality of zones, each zone having at least one terminal unit and at least one air quality sensor, the method further comprising providing a bypass circuit ambient air damper for admitting ambient air into the bypass air airstream, and using the bypass air ambient air damper for admitting sufficient air into the bypass air airstream to ensure that the terminal units can provide for variable amounts of air as needed to satisfy the respective air quality sensors, in response to the hot ambient air condition.

10. The method of claim 6, further comprising providing an ambient air damper and using the ambient air damper for admitting ambient air into the bypass air airstream in response to the hot ambient air condition.

11. The method of claim 10, wherein there is a highest temperature that is needed in the building, the method further comprising cooling the bypass air airstream to said highest temperature.

12. A method for heating, ventilating, and air conditioning a building having a plurality of zones, the zones being maintained at one or more temperatures, each zone having at least one terminal unit and at least one air quality sensor, the HVAC system comprising:

providing a cold air airstream for distribution in the building, and a cooling circuit ambient air damper for admitting ambient air into the cold air airstream;

providing a bypass air airstream for distribution in the building, independent of the cold air airstream, and a bypass circuit ambient air damper for admitting ambient air into the pass air airstream;

determining a hot ambient air condition, where the temperature of the ambient air is higher than the one or more temperatures maintained in the zones; and closing the cooling circuit ambient air damper, and using the bypass circuit ambient air damper for admitting sufficient air into the bypass air airstream to ensure that the terminal units can provide for variable amounts of air as needed to Satisfy the respective air quality sensors, in response to the hot ambient air condition.

13. A method for heating, ventilating, and air conditioning a building having a return air duct and a plurality of zones, the zones being maintained at one or more temperatures, each zone having at least one terminal unit and at least one air quality sensor, comprising:

providing a cold air airstream for distribution in the building;

providing a bypass air airstream for distribution in the building, independent of the cold air airstream, and a return air damper for admitting return air from the return air duct into the bypass air airstream;

determining a hot ambient air condition, where the temperature of the ambient air is higher than the one or more temperatures maintained in the zones; and closing the return air damper in response to the hot ambient air condition, the method further comprising providing a cooling circuit ambient air damper for admitting ambient air into the cold air airstream, and closing the cooling circuit ambient air damper in response to the hot ambient air condition, the method further comprising providing a bypass circuit ambient ambient air damper for admitting sufficient air into the bypass air airstream to ensure that the terminal units can provide for variable amounts of air as needed to satisfy the respective air quality sensors, in response to the hot ambient air condition.

* * * * *